United States Patent [19]

Smith

[11] Patent Number: 4,562,681

[45] Date of Patent: Jan. 7, 1986

[54] WEB SECTION FOR A SPACE FRAME

[75] Inventor: Todd R. Smith, Whitmore Lake, Mich.

[73] Assignee: GTE Products Corporation, Stamford, Conn.

[21] Appl. No.: 698,507

[22] Filed: Feb. 5, 1985

[51] Int. Cl.[4] ..... E04C 3/02

[52] U.S. Cl. ..... 52/648; 52/637; 52/646; 52/650; 52/DIG. 10; 403/171; 403/176; 446/126

[58] Field of Search ..... 52/80, 81, 637, 646, 52/648, 650, DIG. 10; 403/171-178; 446/85, 126

[56] References Cited

U.S. PATENT DOCUMENTS

| | | | |
|---|---|---|---|
| 2,053,462 | 9/1936 | Chaplin . | |
| 2,986,241 | 5/1961 | Fuller | 446/126 X |
| 3,313,082 | 4/1967 | Seaborg et al. | 52/646 |
| 3,332,195 | 7/1967 | Foster . | |
| 3,466,824 | 9/1969 | Troutner | 52/648 |
| 3,477,189 | 11/1969 | Merson . | |
| 3,688,461 | 9/1972 | Rensch . | |
| 3,696,574 | 10/1972 | Dietrich | 52/637 X |
| 3,873,219 | 3/1975 | Pofferi | 403/171 |
| 4,183,190 | 1/1980 | Bance . | |
| 4,483,118 | 11/1984 | Betschart . | |
| 4,484,430 | 11/1984 | Rossman . | |

FOREIGN PATENT DOCUMENTS

| | | | |
|---|---|---|---|
| 2324184 | 11/1973 | Fed. Rep. of Germany | 52/650 |
| 2347136 | 3/1974 | Fed. Rep. of Germany | 52/648 |
| 2409633 | 9/1975 | Fed. Rep. of Germany | 52/648 |
| 879913 | 3/1943 | France | 403/171 |
| 1157537 | 5/1958 | France | 52/648 |
| 1227064 | 9/1961 | France | 52/648 |
| 1450635 | 7/1966 | France | 403/174 |
| 2299469 | 8/1976 | France | 52/648 |

OTHER PUBLICATIONS

Omer W. Blodgett, *Design of Welded Structures,* FIG. 18, pp. 3.2-15.

*Primary Examiner*—Donald G. Kelly
*Assistant Examiner*—Richard E. Chilcot, Jr.
*Attorney, Agent, or Firm*—Ivan L. Ericson

[57] ABSTRACT

A web section for a space frame has a node member attached to each end of the web member. A nodal section of the space frame is made up of four web sections which interconnect the chords of the space frame. Each node member of the web section is one quarter of the nodal section of the space frame. The space frame utilizing these web sections has two levels of chords interconnected by the web sections. The nodal section has a protective cover to cover and protect the fasteners to prevent corrosion as well as to improve the esthetics of the space frame by eliminating any exposed external fasteners.

4 Claims, 11 Drawing Figures

WEB SECTION FOR A SPACE FRAME

FIELD OF THE INVENTION

This invention relates to space frames. More particularly, it relates to space frames of the double layer flat grid type having chords interconnected by a plurality of web sections.

BACKGROUND OF THE INVENTION

Space frames are well known and extensively used in the construction of buildings such as exhibition halls, theatres and the like where large areas are required to be covered, free of supporting columns. For such purposes, architects commonly favor space frames of the double-layer flat grid type, such a structure having an upper square grid assembly of chords spaced above a lower square grid assembly of chords, intersections of the upper and lower grids being interconnected by diagonal struts or web members so that the space frame consists of a combination of square-base pyramidal shapes.

The economy of space frames of this type is particularly sensitive to the cost of the nodal connections of the members comprising the grid. A variety of connector components have been devised for interconnecting: at each node of the structure, the chords and the diagonal struts.

A typical way to make a space frame is to fabricate members and joints as unique parts and bolt them together in the field. Some systems use pyramidal modules which are field assembled.

There are three main disadvantages to those systems:

1. Costs—Where you have separate nodes and many member connections, hardware costs are high.
2. Erection Time and Difficulty—The more pieces you have, the more field assembly time required.
3. Exposed Fasteners—They are unsightly and tend to corrode.

SUMMARY OF THE INVENTION

The space frame of the present invention utilizes a new and unique web section in conjunction with chords which eliminates a separate nodal connection and thereby reducing field assembly time. In addition the fasteners are concealed within the interconnection of the web and chord members of the present invention thereby minimizing the corrosion of the fasteners.

In accordance with one aspect of the present invention, a new and improved web section for a space frame comprises a web member, a first node member, and a second node member. The first node member is one quarter of a first nodal section of the space frame. The space frame has a first planar level of chords and a second planar level of chords which are essentially parallel to each other. The first nodal section of the space frame is an interconnection of four web sections and chords from the first planar level of chords of the space frame. The second node member of the web section is one quarter of a second nodal section of the space frame. The second nodal section is an interconnection of four web sections and chords from the second planar level of chords of the space frame. The web member has a first and second end. The first end of the web member is attached to the first node member and the second end of the web member is attached to the second node member to form the web section. The web member of the web section is nonparallel and non-perpendicular to the chords of the space frame.

In another aspect of the present invention the first node member and the second node member each have a first planar element, a second planar element, and a third planar element. Each planar element of the first node member is perpendicular and attached to each other planar element of the first node member. Each planar element of the second node member is perpendicular and attached to the other planar elements of the second node member. The first, second, and third planar elements of the first node member are essentially parallel to the first, second, and third planar elements of the second node member respectively. The first planar element of the first and the second node member has an outer and inner surface, and the web member has a first end and a second end. The first end of the web member is attached to the outer surface of the first planar element of the first node member and the second end of the web member is attached to the outer surface of the first planar element of the second node member. The web member is at an acute angle with the outer surface of the first planar element of the first node member and of the second node member. The web member of the web section intercepts a projected plane of the second and the third planar elements of the first and the second node member of the web section, and the second and third planar element of the first and second node have a fastening means.

For a better understanding of the present invention, together with other and further objects, advantages and capabilities thereof, reference is made to the following disclosure and appended claims in connection with the above-described drawing.

DETAILED DESCRIPTION OF THE INVENTION

Figure 1:
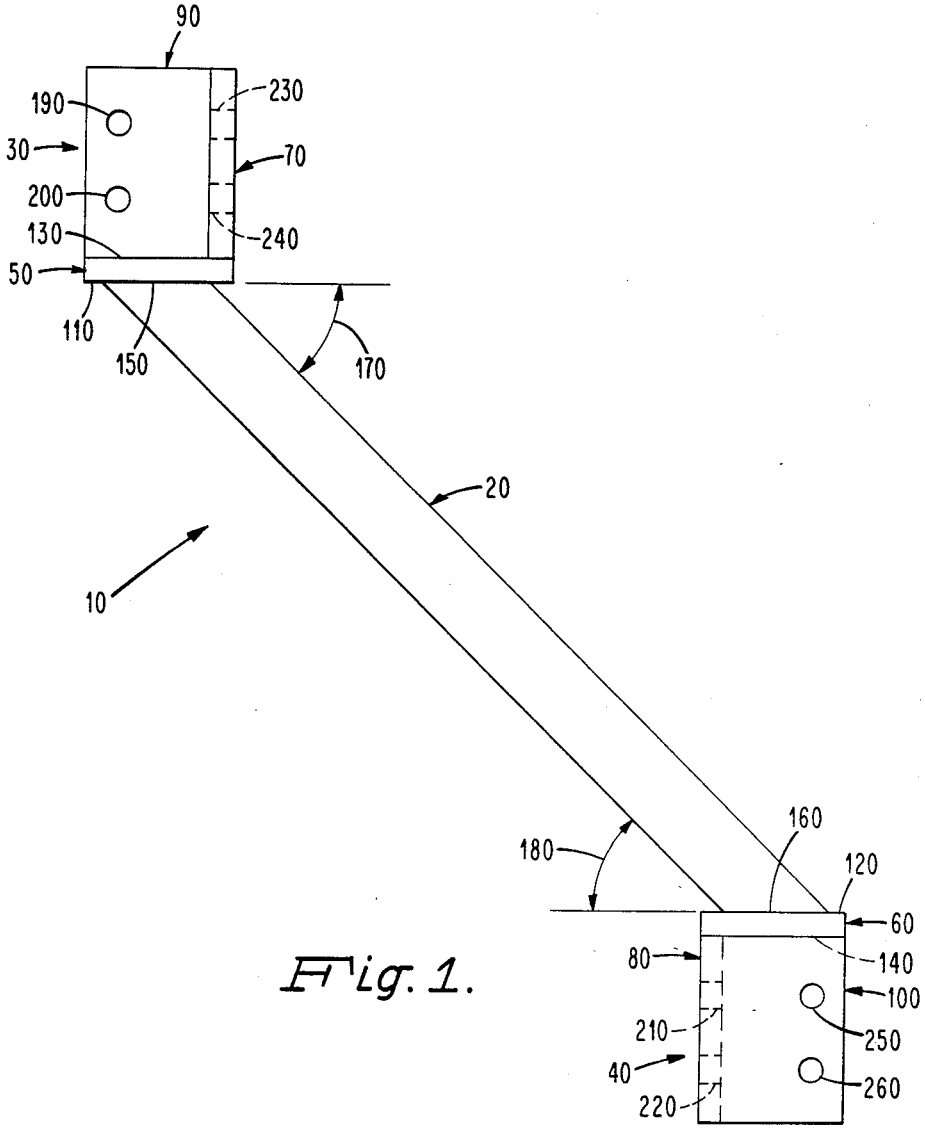
FIG. 1 is an elevational view of a web section of the present invention.
Figure 2:
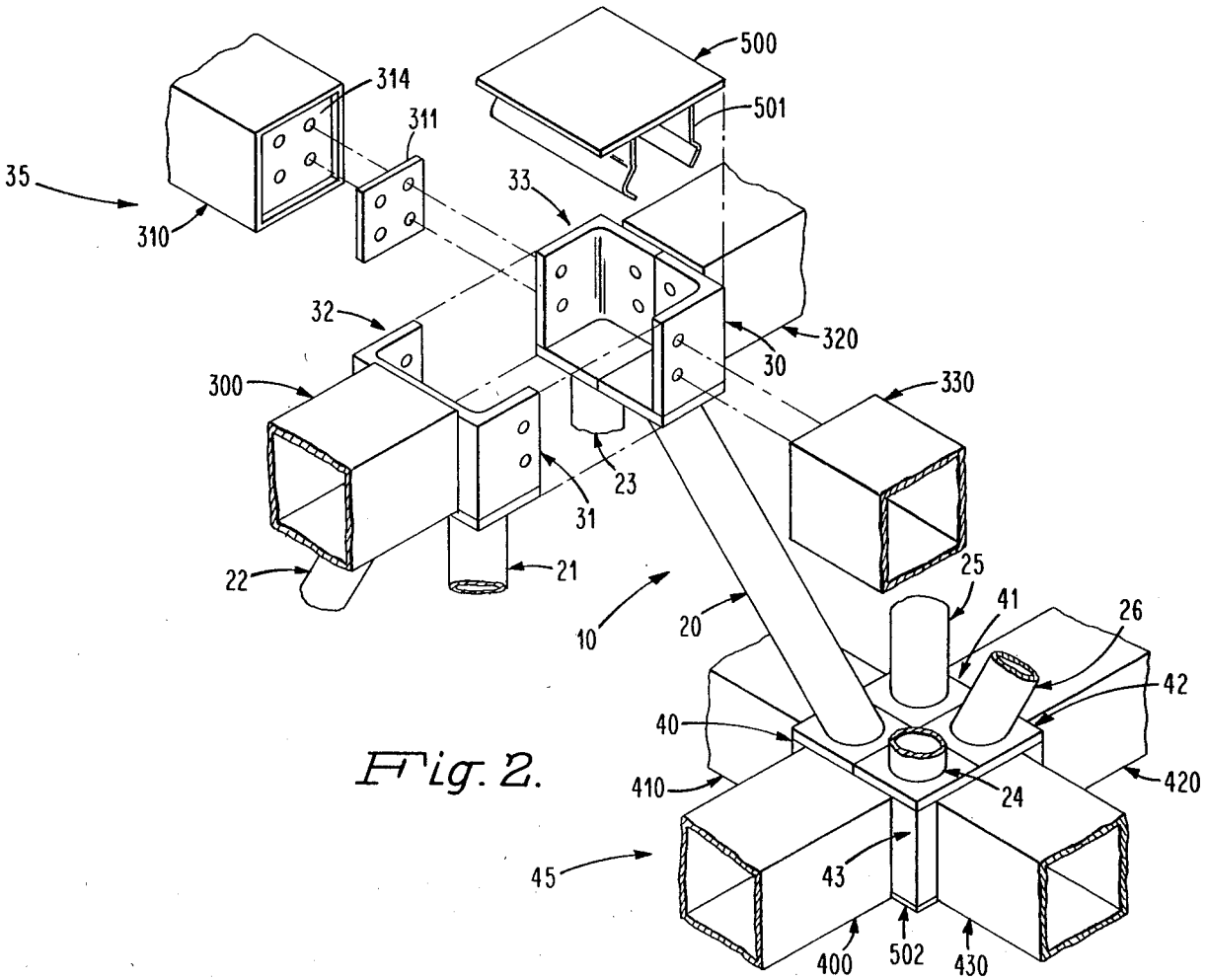
FIG. 2 is an exploded perspective of a web section in conjunction with eight chords, shown in part, to form part of a space frame of the present invention shown as area A in FIG. 7.

One aspect of the invention, shown in FIG. 1, is a web section 10. Web section 10 comprises web member 20, first node member 30, and second node member 40. First node member 30 of web section 10 is one quarter of first nodal section 35, shown in FIG. 3, of space frame 600, shown in FIG. 7. Space frame 600 has first planar level of chords 610 and second planar level of chords 620 which are essentially parallel to each other. First nodal section 35 of space frame 600 is an interconnection of four web sections, 30, 31, 32 and 33 and chords, 300, 310, 320 and 330, shown in FIGS. 2, 3 and 7. Second node member 40 of web section 10 is one quarter of second nodal section 45, shown in FIG. 5, of space frame 600, shown in FIGS. 7. Second node section 45 is an interconnection of four web sections, 40, 41, 42 and 43 and chords 400, 410, 420 and 430, shown in FIGS. 2, 5 and 7. Web member 20 has first end 150 and second end 160, shown in FIG. 1. First end 150 is attached to first node member 30 and second end 160 is attached to second node member 40 to form web section 10, shown in FIG. 1. Web member 20 of web section 10 is non-parallel and non-perpendicular to first and second planar level of chords 610 and 620 respectively.

Also shown in FIG. 1, the first node member 30 and the second node member 40 have respectively first planar elements 50, 60, second planar elements 70, 80, and third planar elements 90, 100. First planar element 50 is perpendicular and attached to second planar elements 70 and third planar element 90, and first planar element 60 is perpendicular and attached to second planar element 80 and third planar element 100. Second planar element 70 is perpendicular and attached to first planar elements 50 and third planar element 90, and second planar element 80 is perpendicular and attached to first planar 60 and third planar element 100. Planar elements 50, 70 and 90 are essentially parallel to planar elements 60, 80 and 100 respectively.

First planar element 50 of first node member 30 has an outer surface 110 and an inner surface 130 and first planar element 60 of second node member 40 has an outer surface 120 and an inner surface 140, shown in FIG. 1.

Web member 20 has a first end 150 and a second end 160. First end 150 is attached to outer surface 110 of first planar element 50 of first node member 30 and second end 160 is attached to outer surface 120 of first planar element 60 of second node member 40 to form a unitary web section.

Web member 20 is at an acute angle 170, and 180 with outer surface 110 and 120 respectively, and web member 20 intercepts projected planes of second and third planar elements 70, 80, 90 and 100. Planar elements 70, 80, 90 and 100 have fastening elements such as apertures 190, 200, 210, 220, 230, 240, 250, and 260.

Figure 6:
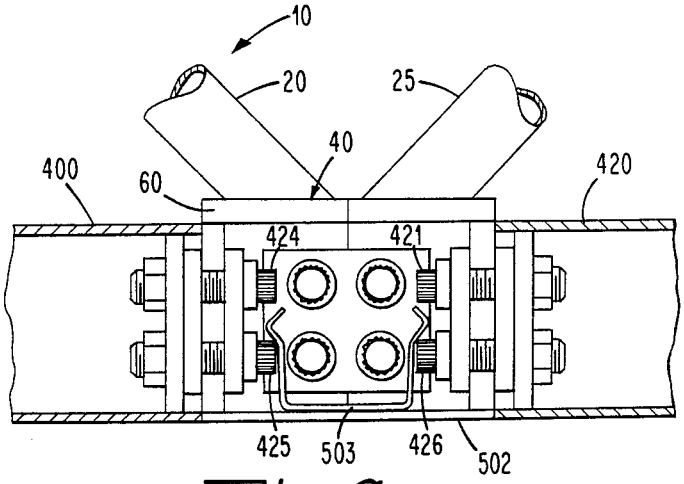
FIG. 6 is an elevational view of FIG. 5 showing the position of a protective cover.
Figure 7:
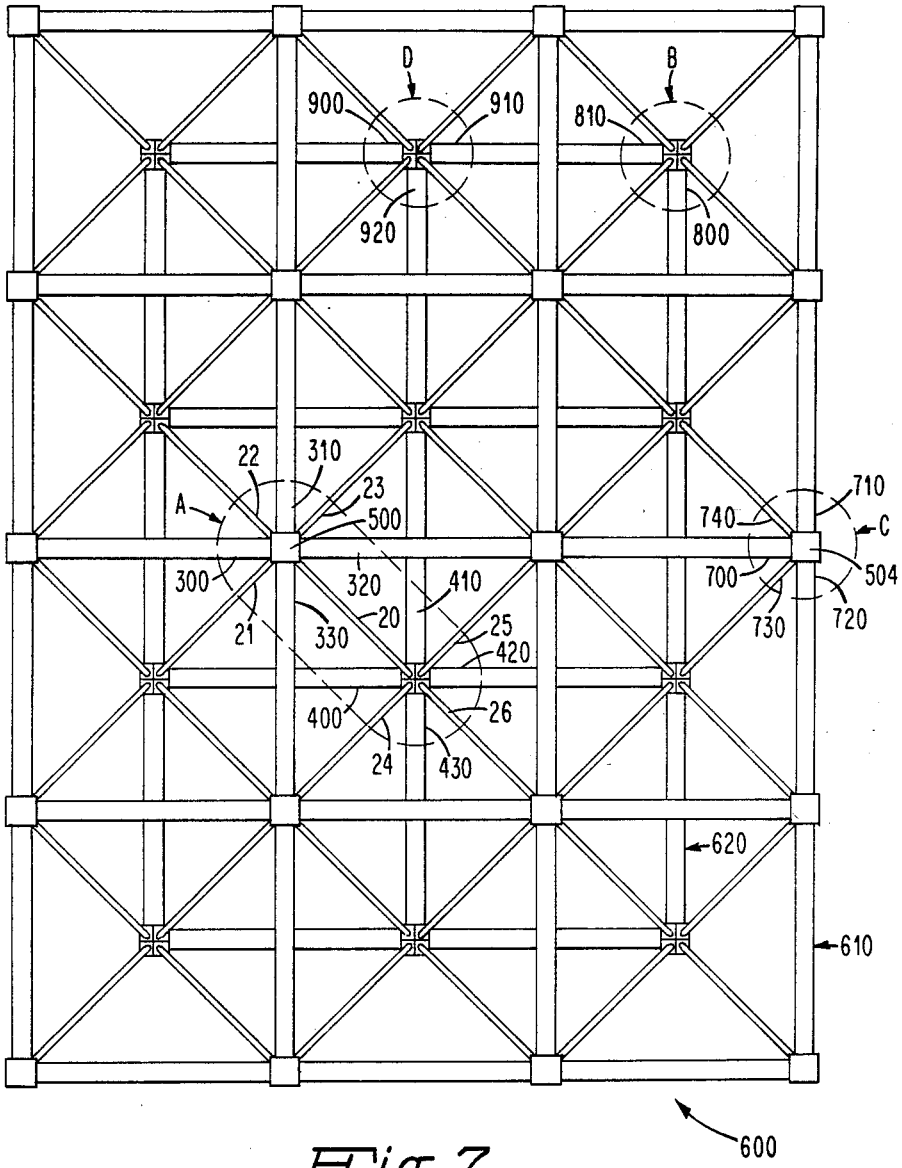
FIG. 7 is a plan view of the space frame of the present invention indicating four areas A, B, C and D which are detailed in FIG. 2, 3, 4, 5, 6, 8, 9, and 10.

Shown in FIG. 7 is a plan view of space frame 600 of the present invention. Space frame 600 comprises a plurality of chords lying in two parallel planes, first planar level of chords 610, and second planar level of chords 620, interconnected by a plurality of web sections such as web section 10. Web section 10 and associated chords 300, 310, 320, 330, 400, 410, 420, and 430 are illustrated in FIGS. 2, 3, 4, 5, 6 and 7. First planar element 50 of the first node member 30, shown in FIG. 3, and first planar element 60 of the second node member 40 of the web section 10, shown in FIG. 6, are parallel with first planar level of chords 610 and second planar level of chords 620, shown in FIG. 7. Second planar element 70 of the first node member 30 of web section 10 is attached to chord 330 of first planar level of chords 610, shown in FIG. 7, by chord fastening elements such as bolt 332, structural plate 333 structural plate 331 and nut 334 welded to face plate 335 of chord 330.

Figure 3:
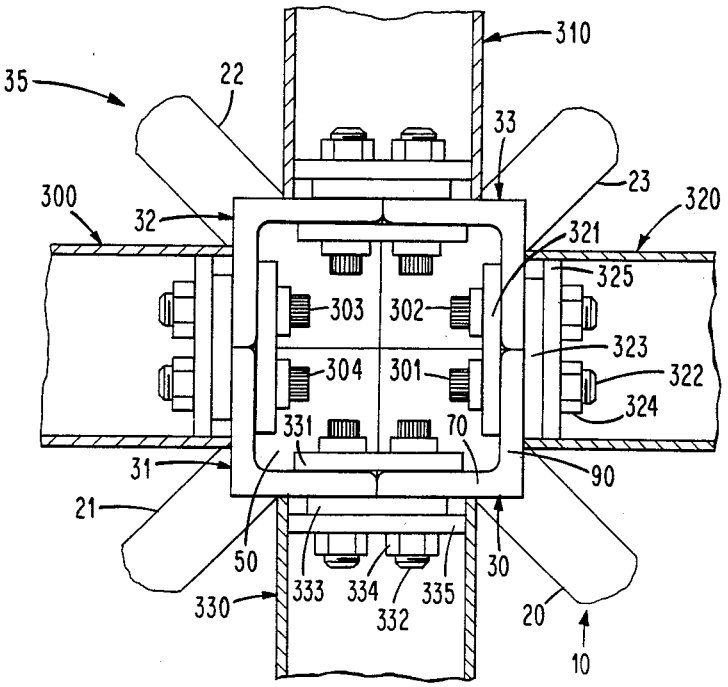
FIG. 3 is a plan view of the interconnection of four web sections with four chords of the present invention located in the first planar level of chords 610 of area A shown in FIG. 7.
Figure 4:
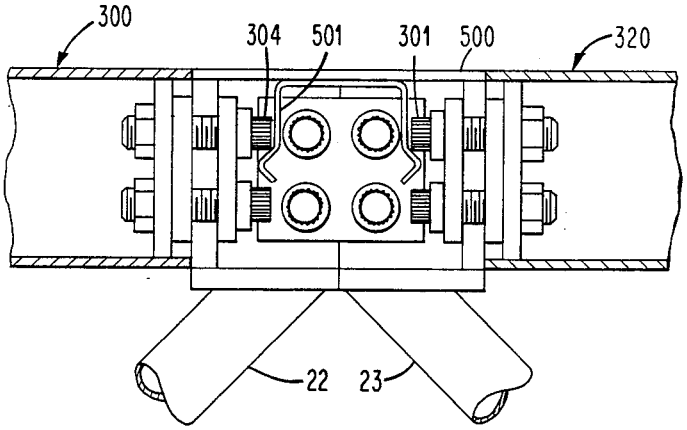
FIG. 4 is an elevational view of FIG. 3 showing the position of a protective cover.

Also shown in FIG. 3 is third planar element 90 of the first node member 30 of web section 10 which is attached to chord 320 of first planar level of chords 610, shown in FIG. 7, by chord fastening elements such as bolt 322, structural plate 323, structural plate 321, and nut 324 welded to face plate 325 of chord 320. Shown in FIG. 4, protective cover 500 attaches to nodal connection combination of nodes 30, 31, 32 and 33, by clip 501 coacting with bolts 301, 302, 303, 304 to protect the bolts from weather corrosion and to enhance the ethetics of space frame 600.

Figure 5:
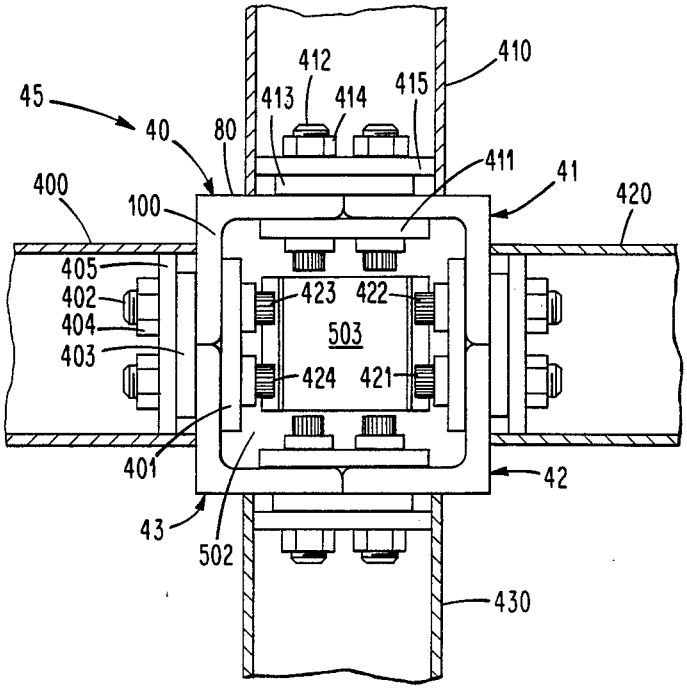
FIG. 5 is a plan view of another variation of four web sections with four chords of the present invention located in the second planar level of chords 620 of area A shown in FIG. 7.

Shown in FIG. 5 is the second planar element 80 of the second node member 40 of web section 10 which is attached to chord 410 of second planar level of chords 620, shown in FIG. 7, by chord fastening elements such as bolt 412, structural plate 413, structural plate 411, and nut 414 welded to face plate 415 of chord 410.

Also shown in FIG. 5 is third planar element 100 of the second node member 40 of web section 10 which is attached to chord 400 of second planar level of chords 620, shown in FIG. 7, by chord fastening elements such as bolt 402, structural plate 403, structural plate 401, and nut 404 welded to face plate 405 of chord 400. Shown in FIG. 6, protective cover 502 attaches to the nodal section 45, a combination of nodes 40, 41, 42 and 43, by clip 503 coacting with bolts such as 425 and 426 to protect the bolts from weather corrosion and to enhance the ethetics of space frame 600.

Figure 9:
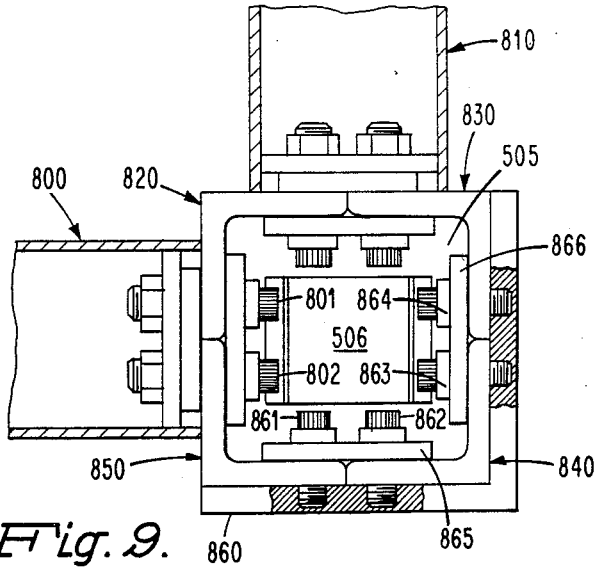
FIG. 9 is a plan view of another variation of the present invention showing the interconnection of four web sections with two chords indicated as area B of the space frame shown in FIG. 7.

Area B of space frame 600, shown in FIG. 7, is detailed in FIG. 9 illustrating the attachment of corner node member 840 to cap off one of the corners of second planar level of chords 620. Corner node member 840 is constructed the same way as first node member 40 except it doesn't have a web member attached to it. Corner node member 840, shown in FIG. 9, is attached to node member 830 and node member 850 by bolting end angle member 860 to node members 830 and 850 with bolts such as 861, 862, 863 and 864. Structural plate 865 juxtaposes with node member 850 and corner node member 840 to enhance load carrying capacity and is secured thereto with bolts such as 861 and 862 which screw into threaded holes of end angle member 860. And structural plate 866 juxtaposes with node member 830 and corner node member 840 and is secured thereto with bolts such as 863 and 864 which also screw into threaded holes of end angle member 860 as shown in FIG. 9. Protective cover 505 covers the node connections by clip 506 which coacts with bolts within the connection thereby protecting the bolts from exposure to the weather which causes corrosion over a period of time and to enhance the ethetics of space frame 600.

Figure 8:
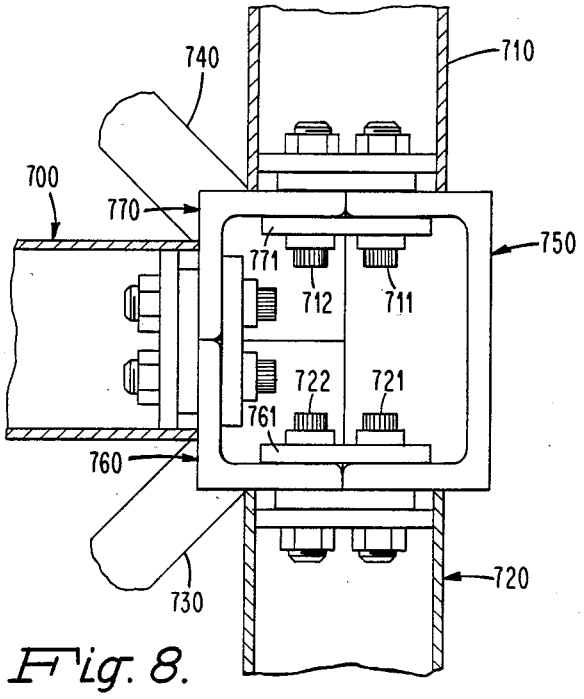
FIG. 8 is a plan view of another variation of the present invention showing the interconnection of two web sections with three chords indicated as area C of the space frame shown in FIG. 7.

Area C of space frame 600, shown in FIG. 7, is detailed in FIG. 8 illustrating the connection of three chords 700, 710 and 720 with two web sections 730 and 740 and the attachment of end node member 750 to chords 710 and 720 to finish off the node connection. End member 750 is secured to chord 710 by bolts such as as 711 and to chord 720 by bolts such as 721. Structural plate 761 juxtaposes with node member 760 and end node member 750 which abuts with node member 760. Structural plate 761, node member 760 and end node member 750 are bolted to chord 720 by bolts such as 721 and 722. Structural plate 761 enhances the load carrying capacity of the connection. A protective cover 504, shown in FIG. 7, similar to protective cover 505, covers the node connections 750, 760 and 770 to protect the bolts such as 711, 712, 721, and 722 from weather corrosion and to improve the esthetics of the space frame by eliminating any exposed external fasteners.

Figure 10:
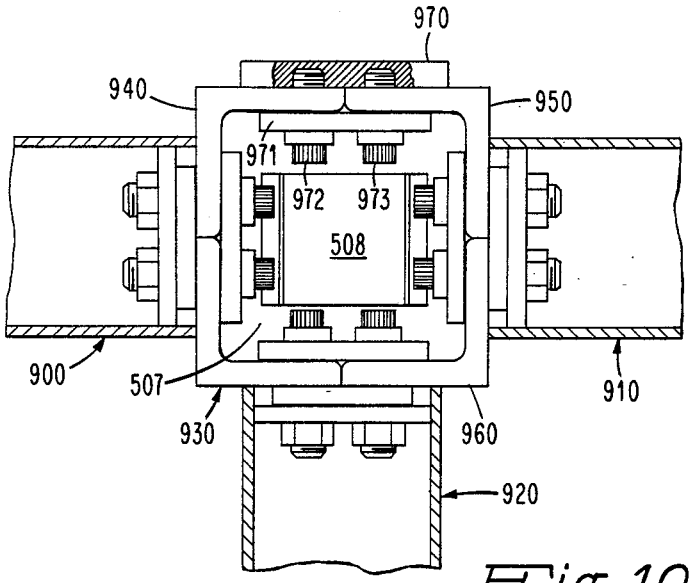
FIG. 10 is a plan view of another variation of the present invention showing the interconnection of four web sections with three chords indicated as area D of the space frame shown in FIG. 7.

Area D of space frame 600, shown in FIG. 7, is detailed in FIG. 10. FIG. 10 illustrates the connection of three chords 900, 910 and 920 with four node members 930, 940, 950 and 960 of four web sections and an end structural plate 970. End structural plate 970 connects node member 940 to abutting node member 950 by bolting structural member 971 which is juxtaposed with node members 940 and 950 to end structural plate 970 using bolts such as 972 and 973. Protective cover 507 is attached to the connection of nodes 930, 940, 950 and 960 by clip 508 coacting with bolts within the connection similar to protective cover 502 shown in FIG. 6.

Figure 11:
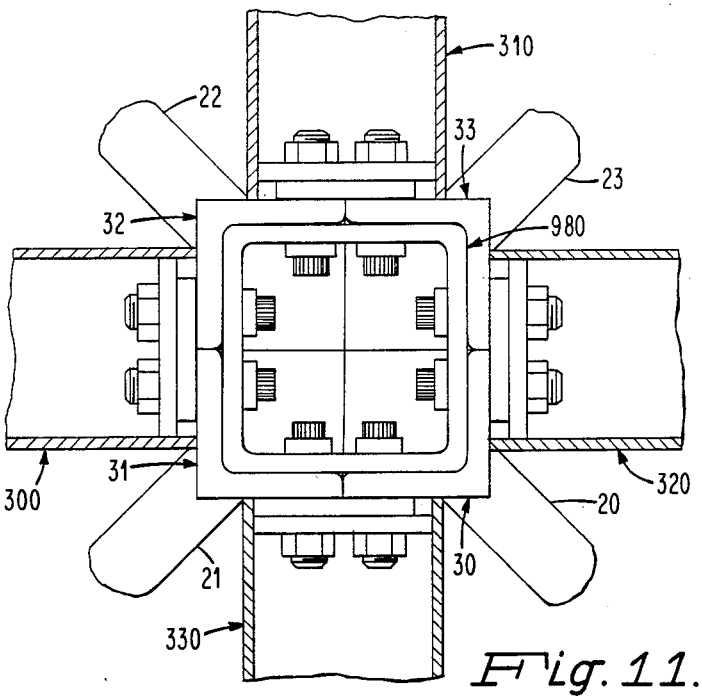
FIG. 11 is a plan view of another variation of FIG. 3.

FIG. 11 shows another embodiment of a connection of four chords and four node members wherein structural member 980 is a tubular member used to increase the load carrying capacity of the connection.

The material of construction of the present invention can be of any suitable structural material such as steel, aluminum, magnesium, wood, etc.

The shape of the chords and web members can vary depending upon the structural and esthetic needs, i.e., such as round, square, elliptical, etc.

While there has been shown and described what is at present considered the preferred embodiment of the invention, it will be obvious to those skilled in the art that various changes and modifications may be made therein without departing from the scope of the invention as defined by the appended claims.

What is claimed is:

1. A web section for a space frame comprising a web member, a first node member, and a second node member, said first node member being one quarter of a first nodal section of said space frame, said space frame having a first planar level of chords and a second planar level of chords being parallel to said first planar level of chords; said first nodal section being an interconnection of four web sections and chords from said first planar level of chords of said space frame, said second node member of said web section being one quarter of a second nodal section of said space frame, said second nodal section being an interconnection of four web sections and chords from said second planar level of chords of said space frame; said web member having a first and a second end, said first end of said web member being attached to said first node member and said second end of said web member being attached to said second node member to form said web section; said web member of said web section being non-parallel and non-perpendicular to said chords of said space frame.

2. A web section for a space frame comprising a web member, a first node member, and a second node member; said first node member and said second node member having a first planar element, a second planar element, and a third planar element, each planar element of said first node member being perpendicular and attached to each other planar element of said first node member, each planar element of said second node member being perpendicular and attached to each other planar element of said second node member, said first, second, and third planar elements of said first node member being essentially parallel to said first, second, and third planar elements of said second node member respectively, said first planar element of said first and said second node member having an outer an inner surface; said web member having a first end and a second end, said first end of said web member being attached to said outer surface of said first planar element of said first node member, said second end of said web member being attached to said outer surface of said first planar element of said second node member; said web member being at an acute angle with said outer surface of said first planar element of said first node member and of said second node member; said web member of said web member intercepting a projected plane of said second and said third planar elements of said first and said second node member of said web section; and said second and third planar element of said first and second node having a fastening means.

3. A space frame comprising a plurality of chords and web sections, each web section being in accordance with claim 1.

4. A space frame comprising a plurality of chords and web sections, each web section being in accordance with claim 2, said chords being interconnected by said web sections to form a first and a second planar level of said chords, said first planar level being essentially parallel with said second planar level of said chords; said first planar element of said first node member and said second node member of said web section being essentially parallel with said first and second level of said chords, said second planar element of said first node member of said web section being attached to a chord element of said first planar of chords by chord fastening means, said third planar element of said first node member of said web section being attached to a different chord element of said first planar level of chords by chord fastening means; said second planar element of said second node member of said web section being attached to a chord element of said second planar level of chords by chord fastening means; and said third planar element of said second node member of said web section being attached to a different chord element of said second planar level of chords by chord fastening means.

* * * * *